US006254658B1

(12) United States Patent
Taniuchi et al.

(10) Patent No.: US 6,254,658 B1
(45) Date of Patent: Jul. 3, 2001

(54) CEMENTED CARBIDE CUTTING TOOL

(75) Inventors: Toshiyuki Taniuchi; Kazuki Okada, both of Ibaraki-ken; Kazuhiro Akiyama, Ohmiya, all of (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/256,207

(22) Filed: Feb. 24, 1999

(51) Int. Cl.[7] ..... C22C 29/08
(52) U.S. Cl. ..... 75/240; 51/307; 419/18
(58) Field of Search ..... 75/228, 236, 240, 75/242; 51/307; 419/18, 38

(56) References Cited

U.S. PATENT DOCUMENTS

| | | | |
|---|---|---|---|
| 4,950,328 | 8/1990 | Odani et al. | 75/240 |
| 5,009,705 | 4/1991 | Yoshimura et al. | 75/240 |
| 5,230,729 | 7/1993 | McCandlish et al. | 75/351 |
| 5,368,628 | 11/1994 | Friederichs | 75/242 |
| 5,372,797 | 12/1994 | Dunmead et al. | 423/430 |
| 5,529,804 | 6/1996 | Bonneau et al. | 427/217 |
| 5,584,907 | 12/1996 | Muhammed et al. | 75/351 |

FOREIGN PATENT DOCUMENTS

| | | |
|---|---|---|
| 61-12847 | 1/1986 | (JP) . |
| 61-11646 | 1/1988 | (JP) . |

*Primary Examiner*—Ngoclan Mai
(74) *Attorney, Agent, or Firm*—Oblon, Spivak, McClelland, Maier & Neustadt, P.C.

(57) ABSTRACT

To provide a cemented carbide cutting tool having high chipping resistance.

In a cutting tool made of a cemented carbide alloy comprising 8 to 13 percent by weight of Co; the Co based alloy containing W and C components as constituents for forming a dispersing phase, a V component, and an optional Cr component, and forming a binding phase; the residual dispersing phase having an average particle diameter of 1 $\mu$m or less; the alloy further containing 72 to 90 percent by area of WC according to measurement of an electron microscopic texture and fine (V,W)C or fine (V,Cr,W)C; each of the contents of the V and Cr components being 0.1 to 2 percent by weight of the total; the tungsten carbide as a constituent of the dispersing phase has a texture in which ultra-fine particles having a particle diameter of 100 nm or less of the Co-based cemented carbide alloy are dispersed in a tungsten carbide matrix.

6 Claims, No Drawings

CEMENTED CARBIDE CUTTING TOOL

DETAILED DESCRIPTION OF THE INVENTION

1. Industrial Field of the Invention

The present invention relates to a cutting tool made of a cemented carbide alloy having high chipping resistance (hereinafter referred to as a "cemented carbide cutting tool"), and more specifically, relates to a cemented carbide cutting tool having a sharp cutting edge and maintaining high cutting characteristics for long service life when used as an end mill having an intermittent cutting mode and when cutting is performed under heavy cutting conditions such as at high feed rate and high cutting depth.

2. Description of the Related Art

For example, Japanese Patent Application Laid-Open Nos. 61-12847 and 63-11646 disclose conventional cemented carbide cutting tools made of a cemented carbide alloy having high chipping resistance composed of 8 to 13 percent by weight of Co; the Co based alloy containing W and C components as constituents for forming a dispersing phase, a V component, and an optional Cr component, and forming a binding phase; the residual dispersing phase having an average particle diameter of 1 $\mu$m or less; the alloy further containing 72 to 90 percent by area of tungsten carbide (hereinafter referred to as "WC") according to measurement of an electron microscopic texture and a fine composite carbide of V and W (hereinafter referred to as "(V,W)C") or a fine composite carbide of V, Cr, and W (hereinafter referred to as "(V,Cr,W)C"); each of the contents of the V and Cr components being 0.1 to 2 percent by weight of the total. Since the cemented carbide cutting tool has high toughness and high strength, it is known that the tool is used in practice as an end mill requiring such properties.

Problems to be solved by the Invention

In recent years, labor and energy saving for cutting tools has been eagerly awaited, and requirement for these cutting tools is towards heavy cutting conditions such as at high feed rate and high cutting depth. When the above conventional cemented carbide cutting tool is applied to an end mill used in an intermittent cutting mode under heavy cutting conditions, chipping (fine fracture) of the cutting edge occurs and thus the life is running out within a relatively short period.

Means for Solving the Problems

The present inventors have directed their attention to the above conventional cemented carbide cutting tool, have researched to improve chipping resistance, and have discovered the following. When using a powdered composite of WC and Co; WC, Co and V; WC, Co and Cr; or WC, Co, V and Cr which is made by adding a distilled water containing dissolved cobalt nitrate as a Co source or dissolved cobalt nitrate with ammonium metavanadate as a V source and/or chromium nitrate as a Cr source to a mixture of tungsten oxide (hereinafter referred to as "$WO_3$") and powdered carbon in a predetermined ratio in place of powdered WC and powdered Co as raw powdered materials, followed by mixing and drying, and then performing, for example, reduction at 1,050° C. for 30 minutes in a nitrogen atmosphere and carbonization at 1,000° C. for 60 minutes in a hydrogen atmosphere, and when using powdered vanadium carbide (hereinafter referred to as "VC") and/or powdered chromium carbide (hereinafter referred to as "$Cr_3C_2$") optionally, the dispersing phase of the cemented carbide alloy constituting the resulting cemented carbide cutting tool is composed of ultra-fine particles of a Co-based alloy having a particle diameter of 100 nm or less dispersed in a WC matrix. Thus, in the cemented carbide cutting tool, the constituents for forming a binding phase which includes major parts of a binding phase between the dispersing phases in the cemented carbide alloy becomes finer and more homogeneous compared to conventional cemented carbide cutting tools having the same content of the constituents for forming the binding phase in the alloy. Based on recognition in which a finer and more homogeneous distribution causes decreased thermal conductivity, the thermal conductivity was measured. This cemented carbide alloy for cutting tools has a thermal conductivity of 0.2 to 0.6 J/cm·sec·°C. compared to 0.7 to 1.0 J/cm·sec·°C. of a conventional cemented carbide alloy, and thus has superior chipping resistance when it is applied to an end mill used in intermittent cutting mode.

The present invention has been completed by the above, and is characterized by a cutting tool made of a cemented carbide alloy having high chipping resistance comprising 8 to 13 percent by weight of Co; the Co based alloy containing W and C components as constituents for forming a dispersing phase, a V component, and an optional Cr component, and forming a binding phase; the residual dispersing phase having an average particle diameter of 1 $\mu$m or less; the alloy further containing 72 to 90 percent by area of WC according to measurement of an electron microscopic texture and fine (V,W)C or fine (V,Cr,W)C; each of the contents of the V and Cr components being 0.1 to 2 percent by weight of the total; wherein the tungsten carbide as a constituent of the dispersing phase has a texture in which ultra-fine particles having a particle diameter of 100 nm or less of the Co-based cemented carbide alloy are dispersed in a tungsten carbide matrix.

The Co content is limited to 8 to 13 percent by weight in the cemented carbide alloy constituting the cemented carbide cutting tool of the present invention, because sufficient toughness is not achieved at a content of less than 8 percent by weight whereas abrasion resistance steeply decreases at a content of higher than 13 percent by weight. The V content is also limited to 0.1 to 2 percent by weight, because the grain growth of the dispersing phase and particularly WC is insufficiently suppressed and thus the average diameter of the dispersing phase cannot be reduced to 1 $\mu$m or less at a content of less than 0.1 percent by weight, whereas toughness significantly decreases at a content of higher than 2 percent by weight due to an excess content of carbide composite containing V. Although Cr which is added, if necessary, improves heat resistance of the binding phase, the heat resistance is not desirably improved at a content of less than 0.1 percent by weight whereas toughness decreases due to an excessively high Cr content in the binding phase at a content of 2 percent by weight. Thus, the Cr content is limited to 0.1 to 2 percent by weight. Furthermore, high toughness is not achieved when the average particle diameter of WC as the dispersing phase is larger than 1 μm. As a result, V must be contained in an amount of 0.1 percent by weight or more while the average particle diameter of the powdered composite is maintained to 1 μm or less, in order to control the average particle diameter of WC to 1 μm or less.

The diameter and the density of ultra-fine particles dispersed in the dispersing phase of the cemented carbide alloy is controlled by adjusting the average diameters of the powdered tungsten oxide and carbon which are used and by adjusting the conditions for reduction and carbonization. Since hardness and abrasion resistance unavoidably decrease if ultra-fine particles having a particle diameter higher than 100 nm are present in such a case, the diameter of the ultra-fine particles is limited to 100 nm or less.

The rate of WC in the matrix is limited to a range of 72 to 90 percent by area, because desired abrasion resistance is not achieved at a rate of less than 72 percent whereas strength of the cemented carbide alloy decreased at a rate of higher than 90%.

Description of the Embodiments

The cemented carbide cutting tool of the present invention will now be described in further detail with reference to examples.

Powdered $WO_3$ with an average particle diameter of 0.6 μm, powdered carbon with an average particle diameter of 0.4 μm, and a mixed solvent composed of a distilled water containing a predetermined amount of dissolved cobalt nitrate [$Co(NO_3)_2 \cdot 6H_2O$] and a distilled water containing predetermined amounts of cobalt nitrate, and ammonium metavanadate ($NH_4VO_3$) and/or chromium nitrate [$Cr(NO_3)_3$] were prepared. These powdered $WO_3$ and carbon and mixed solvent in a predetermined ratio were placed into a ball mill, wet-mixed for 72 hours, and dried. The mixture was subjected to reduction at 1,050° C. for 30 minutes in a nitrogen atmosphere and then carbonization at 1,000° C. for 60 minutes in a hydrogen atmosphere. Powdered composites A to T composed of WC and Co, composed of WC, Co and V, composed of WC, Co and Cr, or composed of WC, Co, V and Cr having the formulations and average particle diameters shown in Tables 1 and 2 were thereby prepared.

Powdered VC having an average particle diameter of 1.6 μm and/or powdered $Cr_3C_2$ having an average particle diameter of 2.3 μm were compounded in amounts shown in Tables 3 and 4 with each of the powdered composites A to T. Each of the powdered composites A to T was pulverized by wet mixing for 72 hours in a ball mill, dried, and compacted under a pressure of 1 ton/cm$^2$ to form a green compact with a diameter of 13 mm and a length of 75 mm. The green compact was sintered at a predetermined temperature in a range of 1,380 to 1,480° C. for 1 hour in vacuo, and the sintered compact (cemented carbide alloy) was finished by grinding to form an end mill shape having a peripheral cutting edge with a diameter of 10 mm and a length of 70 mm. Cemented carbide cutting tools 1 to 20 in accordance with the present invention were thereby produced.

For comparison, conventional cemented carbide cutting tools 1 to 20 were produced under the same conditions, except for using powdered WC with an average particle diameter of 0.8 μm, powdered $Cr_3C_2$ with an average particle diameter of 2.3 μm, and powdered Co with an average particle diameter of 1.2 μm in the formulations shown in Tables 3 and 4.

The Rockwell hardness (Scale A) and the thermal conductivity at room temperature in vacuo by a laser flash method of each of these cemented carbide cutting tools were measured, and the Co, V and Cr contents were measured. An arbitrary cross-section of each alloy was observed by a scanning electron microscope (SEM) to measure the ratio and average particle diameter of WC. Using a transmission electron microscope (TEM), it was confirmed that the dispersing phase was composed of WC, and fine (V,W)C or (V,Cr,W)C, and whether ultra-fine particles were present or not in the dispersing phase was observed at a magnification of 350,000×. When ultra-fine particles were present, the maximum particle diameter was measured and the major components thereof were identified using an energy dispersive X-ray spectrometer (EDS).

Each cemented carbide cutting tool (end mill) was subjected to a high-cutting-rate wet cutting test of steel under the following conditions to measure the abrasion width of the peripheral edge:

Material to be cut: S45C (hardness (HB): 240)

Cutting speed: 60 m/min

Feed rate: 0.04 mm/tooth

Depth of cut in the axis direction: 15 mm

Depth of cut in the radial direction: 2 mm

Cut length: 15 m

The results are shown in Tables 5 to 8.

TABLE 1

| Type | | Average Diameter (μm) | Formulation (weight percent) Co | V | Cr | WC |
|---|---|---|---|---|---|---|
| Powdered Composite | A | 1.0 | 12.8 | — | — | Balance |
| | B | 0.9 | 11.5 | — | — | Balance |
| | C | 0.8 | 10.2 | — | — | Balance |
| | D | 0.8 | 9.9 | — | — | Balance |
| | E | 0.7 | 8.3 | — | — | Balance |
| | F | 0.8 | 12.7 | — | 2.8 | Balance |
| | G | 0.8 | 12.2 | — | 1.5 | Balance |
| | H | 0.7 | 10.2 | — | 0.65 | Balance |
| | I | 0.6 | 10.0 | — | 0.60 | Balance |
| | J | 0.5 | 8.1 | — | 0.22 | Balance |

TABLE 2

| Type | | Average Diameter (μm) | Formulation (weight percent) Co | V | Cr | WC |
|---|---|---|---|---|---|---|
| Powdered Composite | K | 12.5 | 0.6 | 1.8 | — | Balance |
| | L | 0.6 | 12.0 | 1.1 | — | Balance |
| | M | 0.5 | 10.6 | 0.42 | — | Balance |
| | N | 0.4 | 10.2 | 0.30 | — | Balance |
| | O | 0.3 | 8.3 | 0.21 | — | Balance |
| | P | 0.5 | 12.9 | 1.8 | 1.8 | Balance |
| | Q | 0.5 | 11.7 | 0.25 | 1.6 | Balance |
| | R | 0.4 | 10.0 | 1.5 | 0.22 | Balance |
| | S | 0.2 | 8.3 | 0.24 | 0.35 | Balance |
| | T | 0.3 | 7.8 | 0.12 | 0.10 | Balance |

[TABLE 3]

| Type of cemented carbide cutting tool of this invention | Formulation (weight %) Powdered composite | VC | $Cr_3C_2$ | Type of conventional cemented carbide cutting tool | Formulation (weight %) WC | VC | $Cr_3C_2$ | Co |
|---|---|---|---|---|---|---|---|---|
| 1 | A: balance | 2.0 | — | 1 | Balance | 2.0 | — | 13 |
| 2 | B: balance | 1.0 | — | 2 | Balance | 1.5 | — | 13 |
| 3 | C: balance | 0.4 | — | 3 | Balance | 1.4 | — | 12 |
| 4 | D: balance | 0.3 | — | 4 | Balance | 1.0 | — | 12 |
| 5 | E: balance | 0.2 | — | 5 | Balance | 0.5 | — | 10 |
| 6 | K: 100 | — | — | 6 | Balance | 0.4 | — | 10 |
| 7 | L: 100 | — | — | 7 | Balance | 1.0 | — | 9 |
| 8 | M: 100 | — | — | 8 | Balance | 0.6 | — | 9 |
| 9 | N: 100 | — | — | 9 | Balance | 0.3 | — | 8 |
| 10 | O: 100 | — | — | 10 | Balance | 0.2 | — | 8 |

[TABLE 4]

| Type of cemented carbide cutting tool of this invention | Formulation (weight %) Powdered composite | VC | $Cr_3C_2$ | Type of conventional cemented carbide cutting tool | Formulation (weight %) WC | VC | $Cr_3C_2$ | Co |
|---|---|---|---|---|---|---|---|---|
| 11 | A: balance | 2.0 | 2.0 | 11 | Balance | 2.0 | 2.0 | 13 |
| 12 | G: balance | 0.3 | — | 12 | Balance | 1.5 | 1.5 | 13 |
| 13 | I: balance | 1.5 | — | 13 | Balance | 0.3 | 1.5 | 12 |
| 14 | M: balance | — | 1.5 | 14 | Balance | 1.0 | 1.0 | 12 |
| 15 | O: balance | — | 0.3 | 15 | Balance | 1.5 | 0.6 | 10 |
| 16 | P: 100 | — | — | 16 | Balance | 0.4 | 1.5 | 10 |
| 17 | Q: 100 | — | — | 17 | Balance | 1.0 | 0.4 | 9 |
| 18 | R: 100 | — | — | 18 | Balance | 0.4 | 0.5 | 9 |
| 19 | S: 100 | — | — | 19 | Balance | 0.2 | 0.3 | 8 |
| 20 | T: 100 | — | — | 20 | Balance | 0.1 | 0.1 | 8 |

[TABLE 5]

| Type of cemented carbide cutting tool of this invention | Hardness ($H_RA$) | Thermal conductivity (J/cm · sec · ° C.) | Co content (weight %) | V content (weight %) | Cr content (weight %) | Dispersing phase Ratio (area %) | Dispersing phase Average diameter (μm) | Ultra-fine particles Observed or not | Ultra-fine particles Maximum diameter (nm) | Ultra-fine particles Major component | Abrasion width of peripheral edge (mm) |
|---|---|---|---|---|---|---|---|---|---|---|---|
| 1 | 91.5 | 0.40 | 12.5 | 1.60 | — | 75.4 | 0.3 | Observed | 81 | Co | 0.38 |
| 2 | 91.8 | 0.35 | 11.3 | 0.78 | — | 79.2 | 0.4 | Observed | 66 | Co | 0.40 |
| 3 | 92.4 | 0.39 | 10.1 | 0.35 | — | 82.4 | 0.6 | Observed | 31 | Co | 0.35 |
| 4 | 92.5 | 0.33 | 9.7 | 0.29 | — | 83.1 | 0.3 | Observed | 20 | Co | 0.30 |
| 5 | 92.8 | 0.52 | 8.0 | 0.20 | — | 85.8 | 0.2 | Observed | 75 | Co | 0.29 |
| 6 | 91.5 | 0.41 | 12.6 | 1.87 | — | 75.0 | 0.3 | Observed | 92 | Co | 0.28 |
| 7 | 91.7 | 0.34 | 12.0 | 1.06 | — | 77.4 | 0.5 | Observed | 78 | Co | 0.29 |
| 8 | 92.1 | 0.48 | 10.6 | 0.40 | — | 81.5 | 0.4 | Observed | 53 | Co | 0.25 |
| 9 | 92.6 | 0.38 | 10.1 | 0.31 | — | 82.4 | 0.4 | Observed | 13 | Co | 0.28 |
| 10 | 92.7 | 0.55 | 8.2 | 0.23 | — | 85.5 | 0.2 | Observed | 27 | Co | 0.20 |

[TABLE 6]

| Type of cemented carbide cutting tool of this invention | Hardness ($H_RA$) | Thermal conductivity (J/cm · sec · ° C.) | Co content (weight %) | V content (weight %) | Cr content (weight %) | Dispersing phase Ratio (area %) | Dispersing phase Average diameter (μm) | Ultra-fine particles Observed or not | Ultra-fine particles Maximum diameter (nm) | Ultra-fine particles Major component | Abrasion width of peripheral edge (mm) |
|---|---|---|---|---|---|---|---|---|---|---|---|
| 11 | 91.8 | 0.36 | 12.6 | 1.66 | 1.72 | 73.4 | 0.6 | Observed | 63 | Co | 0.35 |
| 12 | 91.5 | 0.42 | 12.2 | 0.20 | 1.55 | 77.2 | 0.5 | Observed | 28 | Co | 0.35 |
| 13 | 92.6 | 0.38 | 9.9 | 1.28 | 0.58 | 80.0 | 0.3 | Observed | 11 | Co | 0.32 |
| 14 | 92.4 | 0.35 | 10.8 | 0.39 | 1.33 | 79.5 | 0.4 | Observed | 55 | Co | 0.28 |
| 15 | 92.7 | 0.57 | 8.0 | 0.18 | 0.22 | 85.3 | 0.3 | Observed | 88 | Co | 0.25 |
| 16 | 91.7 | 0.31 | 12.6 | 1.82 | 1.80 | 72.8 | 0.2 | Observed | 37 | Co | 0.33 |
| 17 | 91.5 | 0.50 | 11.7 | 0.24 | 1.66 | 77.8 | 0.5 | Observed | 32 | Co | 0.38 |
| 18 | 92.1 | 0.49 | 10.4 | 1.55 | 0.20 | 80.1 | 0.2 | Observed | 76 | Co | 0.29 |
| 19 | 92.8 | 0.51 | 8.1 | 0.21 | 0.31 | 85.1 | 0.2 | Observed | 94 | Co | 0.26 |
| 20 | 92.9 | 0.42 | 8.0 | 0.13 | 0.13 | 86.6 | 0.3 | Observed | 64 | Co | 0.21 |

[TABLE 7]

| Type of conventional cemented carbide cutting tool | Hardness ($H_RA$) | Thermal conductivity (J/cm · sec · ° C.) | Co content (weight %) | V content (weight %) | Cr content (weight %) | Dispersing phase Ratio (area %) | Dispersing phase Average diameter (μm) | Ultra-fine particles Observed or not | Ultra-fine particles Maximum diameter (nm) | Ultra-fine particles Major component | Life of peripheral edge by chipping |
|---|---|---|---|---|---|---|---|---|---|---|---|
| 1 | 91.6 | 0.77 | 12.8 | 1.62 | — | 74.7 | 0.3 | Not obs. | — | — | 12 min. |
| 2 | 91.7 | 0.70 | 12.9 | 1.20 | — | 75.8 | 0.5 | Not obs. | — | — | 15 min. |
| 3 | 91.8 | 0.71 | 12.1 | 1.11 | — | 77.4 | 0.3 | Not obs. | — | — | 7 min. |
| 4 | 91.8 | 0.75 | 11.8 | 0.80 | — | 78.3 | 0.6 | Not obs. | — | — | 9 min. |
| 5 | 92.4 | 0.81 | 10.0 | 0.41 | — | 82.4 | 0.5 | Not obs. | — | — | 15 min. |
| 6 | 92.2 | 0.75 | 10.1 | 0.35 | — | 82.7 | 0.4 | Not obs. | — | — | 18 min. |
| 7 | 92.7 | 0.81 | 8.9 | 0.83 | — | 82.7 | 0.2 | Not obs. | — | — | 18 min. |
| 8 | 92.8 | 0.85 | 9.0 | 0.49 | — | 83.7 | 0.3 | Not obs. | — | — | 19 min. |
| 9 | 92.8 | 0.93 | 8.2 | 0.24 | — | 86.0 | 0.3 | Not obs. | — | — | 22 min. |
| 10 | 93.0 | 0.91 | 7.9 | 0.20 | — | 86.2 | 0.3 | Not obs. | — | — | 24 min. |

[TABLE 8]

| Type of conventional cemented carbide cutting tool | Hardness ($H_RA$) | Thermal conductivity (J/cm · sec · ° C.) | Co content (weight %) | V content (weight %) | Cr content (weight %) | Dispersing phase Ratio (area %) | Dispersing phase Average diameter (μm) | Ultra-fine particles Observed or not | Ultra-fine particles Maximum diameter (nm) | Ultra-fine particles Major component | Service life of peripheral edge by chipping |
|---|---|---|---|---|---|---|---|---|---|---|---|
| 11 | 91.7 | 0.70 | 13.3 | 1.54 | 1.76 | 73.2 | 0.5 | Not obs. | — | — | 13 min. |
| 12 | 91.6 | 0.72 | 13.1 | 1.15 | 1.31 | 74.6 | 0.6 | Not obs. | — | — | 8 min. |
| 13 | 91.8 | 0.75 | 11.7 | 0.24 | 1.25 | 77.9 | 0.5 | Not obs. | — | — | 11 min. |
| 14 | 91.9 | 0.80 | 11.9 | 0.80 | 0.87 | 77.5 | 0.4 | Not obs. | — | — | 12 min. |
| 15 | 92.5 | 0.82 | 10.5 | 1.23 | 0.52 | 80.2 | 0.3 | Not obs. | — | — | 16 min. |
| 16 | 92.3 | 0.77 | 9.9 | 0.32 | 1.23 | 80.6 | 0.3 | Not obs. | — | — | 15 min. |
| 17 | 92.7 | 0.78 | 8.7 | 0.80 | 0.35 | 82.8 | 0.2 | Not obs. | — | — | 19 min. |
| 18 | 92.9 | 0.91 | 9.2 | 0.31 | 0.43 | 83.7 | 0.3 | Not obs. | — | — | 22 min. |
| 19 | 92.9 | 0.85 | 8.1 | 0.15 | 0.25 | 85.9 | 0.2 | Not obs. | — | — | 20 min. |
| 20 | 92.9 | 0.97 | 8.0 | 0.10 | 0.10 | 86.4 | 0.2 | Not obs. | — | — | 25 min. |

Advantage(s)

The results shown in Tables 5 to 8 demonstrate that the cemented carbide cutting tools 1 to 20 in accordance with the present invention have superior chipping resistance under high-cutting depth conditions of an end mill used in an intermittent cutting mode due to the presence of ultra-fine particles composed of a Co-based alloy having a particle diameter of 100 nm or less dispersed in WC and due to a finer and more homogeneous distribution of the binding phase which is evaluated by a relatively low thermal conductivity. In contrast, the conventional cemented carbide cutting tools 1 to 20 have relatively short service lives due to low chipping resistance, although the hardness, the Co, V and Cr contents, the rate of WC, and the average particle diameter are substantially the same as those in the cemented carbide cutting tools of the present invention.

As described above, the cemented carbide cutting tool of this invention has high chipping resistance and has superior cutting characteristics without chipping of the cutting edge for long periods under intermittent heavy cutting conditions such as at a high feed rate or a high cutting depth, in addition to continuous cutting conditions. Thus, the tool satisfactorily contributes to labor and energy saving in cutting operations.

What is claimed is:

1. A cutting tool comprising a cemented carbide alloy, the cemented carbide alloy containing a binding phase and a dispersing phase in the binding phase, wherein the binding phase comprises a first Co-based alloy containing W, C, and V;

the dispersing phase has an average particle diameter of 1 μm or less and includes a tungsten carbide matrix and particles comprising a second Co-based alloy with particle diameters of 100 nm or less dispersed in the tungsten carbide matrix;

the tungsten carbide matrix forms 72 to 90 percent by area of a cross-section of the cemented carbide alloy;

the second Co-based alloy contains W, C, and V; and the cemented carbide alloy comprises 8 to 13 wt % Co and 0.1 to2wt % V.

2. The cutting tool according to claim 1, wherein the first Co-based alloy and the second Co-based alloy each further comprises Cr, and the cemented carbide alloy further comprises 0.1 to 2 wt % Cr.

3. A cemented carbide alloy containing a binding phase and a dispersing phase in the binding phase, wherein the binding phase comprises a first Co-based alloy containing W, C, and V;

the dispersing phase has an average particle diameter of 1 μm or less and includes a tungsten carbide matrix and particles comprising a second Co-based alloy with particle diameters of 100 nm or less dispersed in the tungsten carbide matrix;

the tungsten carbide matrix forms 72 to 90 percent by area of a cross-section of the cemented carbide alloy;

the second Co-based alloy contains W, C, and V; and the cemented carbide alloy comprises 8 to 13 wt % Co and 0.1 to 2wt % V.

4. The cemented carbide alloy according to claim 3, wherein the first Co-based alloy and the second Co-based alloy each further comprises Cr, and the cemented carbide alloy further comprises 0.1 to 2 wt % Cr.

5. A method of making a cutting tool, the method comprising grinding the cemented carbide alloy of claim 3 to form the cutting tool.

6. A method of making a cemented carbide alloy, the method comprising mixing tungsten oxide powder, carbon powder, and an aqueous solution comprising Co and at least one of V and Cr to form a mixture;

drying the mixture;

reducing the mixture;

carbonizing the mixture to form a powdered composite;

compounding the powdered composite with at least one of VC and $Cr_3C_2$ to form a compounded mixture;

sintering the compounded mixture; and forming the cemented carbide alloy of claim 3.

* * * * *